United States Patent [19]

Wooten

[11] 4,445,739

[45] May 1, 1984

[54] MALE PLUG WITH AUTOMATIC PRONG COVER

[76] Inventor: Norman W. Wooten, 5751 55th Ter. North, St. Petersburg, Fla. 33709

[21] Appl. No.: 374,786

[22] Filed: May 4, 1982

[51] Int. Cl.[3] ..... H01R 13/44

[52] U.S. Cl. ..... 339/42

[58] Field of Search ..... 339/42

[56] References Cited

U.S. PATENT DOCUMENTS

| | | | |
|---|---|---|---|
| 2,396,901 | 3/1946 | Tiffany | 339/42 |
| 2,444,843 | 7/1948 | Modrey | 339/42 |
| 3,754,205 | 8/1973 | Lenkey | 339/42 |
| 3,839,697 | 10/1974 | Obert | 339/42 |
| 4,203,640 | 5/1980 | Bice et al. | 339/42 |
| 4,340,267 | 7/1982 | Nukaga | 339/42 |

FOREIGN PATENT DOCUMENTS

| | | | |
|---|---|---|---|
| 1215909 | 4/1960 | France | 339/42 |
| 622459 | 6/1961 | Italy | 339/42 |
| 81684 | 11/1919 | Switzerland | 339/42 |
| 315106 | 7/1929 | United Kingdom | 339/42 |

*Primary Examiner*—John McQuade
*Assistant Examiner*—Paula Austin
*Attorney, Agent, or Firm*—Harvey B. Jacobson

[57] ABSTRACT

An elongated plug body constructed of dielectric material is provided. One end portion of the body includes a pair of parallel elongated conductive terminals embedded therein and having one pair of ends projecting endwise outwardly of the corresponding body end. The other ends of the terminals are supported in the other end portion of the body for electrical connection with a pair of conductors. The aforementioned one end portion of the body includes a sleeve slidingly telescoped thereover and closed at its outer end by an end wall having a pair of openings formed therethrough in which the terminals are slidingly received and the sleeve is shiftable between an outer position with the free ends of the terminals disposed in the openings and an inner position with the end wall of the sleeve abutted against the end of the body outwardly from which the terminals project. Spring structure yieldingly biases the sleeve toward its outer position. In a first form of the invention, the ends of the terminals embedded in the body have the exposed ends of a pair of insulated flexible conductors electrically connected thereto with the other ends of the conductors projecting outwardly of the body. In a second form of the invention cavities are provided opening endwise outwardly of the other end of the body into which the free ends of the terminals of a male electrical plug may be telescoped for electrical contact with the body terminals.

12 Claims, 11 Drawing Figures

MALE PLUG WITH AUTOMATIC PRONG COVER

BACKGROUND OF THE INVENTION

Various forms of safety electrical plugs heretofore have been provided for use in conjunction with extension cords to be plugged into a wall socket or the like. Such safety plugs include various types of sleeves which are extendible and retractable relative to the outwardly projecting terminals of the plugs and which at least substantially enclose the outer ends of the terminals when the plugs are not plugged into receptacles and which are automatically retractable to expose the plug terminals as the plug is engaged with a receptacle. However, many of these safety plugs are complex in structure and include protective sleeve portions which, when fully extended, do not fully enclose the free ends of the outwardly projecting terminals of the associated plugs. In addition, few, if any, efforts have been made to provide an adapter for a conventional male plug into which the terminals of the male plug may be telescoped and electrically connected with terminals of the adapter with which a retractable cover sleeve is operatively associated.

Accordingly, a need exists for an improved form of electrical plug having a retractable terminal enclosing sleeve operatively associated therewith and which may be of simple construction and readily incorporated in the manufacture of extension cords and the like having male plugs on specified ends thereof. In addition, a more immediate need exists for an adapter type plug which may be utilized to transform conventional male plugs into plugs equipped with terminal shielding safety sleeves.

Examples of safety plugs, including some of the general structural and operational features of the instant invention, are disclosed in U.S. Pat. Nos. 2,082,986, 2,396,901, 3,513,435, 3,575,684 3,629,790 and 3,754,205.

SUMMARY OF THE INVENTION

The male plug of the instant invention is equipped with a retractable sleeve which functions, when extended, to totally shield the stationary outwardly projecting terminals of the plug from contact by the user's fingers. The plug is also disclosed in the form of an adapter into which a conventional male plug may be plugged at one end and which is provided with retractable sleeve protected outwardly projecting terminals on its other end for telescopic engagement with an electrical outlet female receptacle.

The main object of this invention is to provide a shielded male plug construction which may be readily incorporated in the manufacture of replacement male plugs or original equipment male plugs to which extension cords are electrically connected.

Another object of this invention is to provide a shielded male plug construction in the form of an adapter which may be utilized in conjunction with a standard male plug in order to transform the latter into a plug having shielded terminals.

Still another object of this invention is to provide a shielded plug construction in accordance with the preceding objects and including structural features thereof which enable ease of assembly of the plug body and plug terminal shielding sleeve portions of the invention.

A final object of this invention to be specifically enumerated herein is to provide a shielded terminal electrical plug construction in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
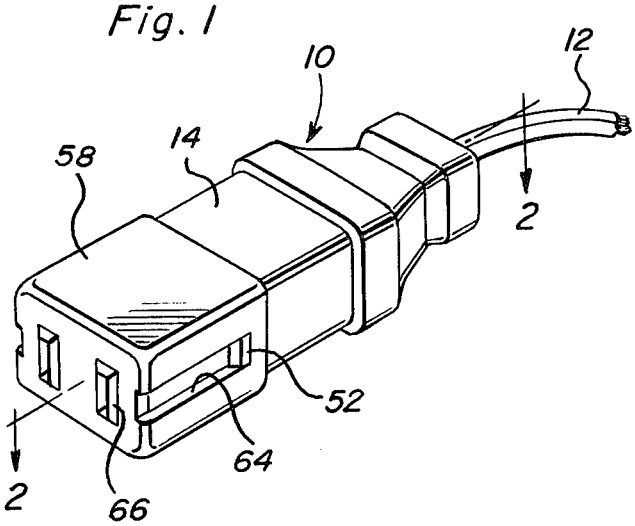
FIG. 1 is a perspective view of a male extension cord plug constructed in accordance with the present invention.

Referring now more specifically to the drawings, the numeral 10 generally designates the original equipment plug of the instant invention which is molded about the end of an extension cord 12 to be removably electrically connected to a source of electrical potential such as the female contacts within a wall receptacle or the like.

The plug 10 includes a body 14 of suitable dielectric material, such as ABS plastic, and the body 14 includes first and second end portions 16 and 18. A Y-shaped cavity 20 is molded into the end portion 18 and includes a pair of laterally spaced arms 22 and 24 and a base leg 26 which opens endwise outwardly of the end face 28 of the second end portion 18.

Molded within the body 14 are a pair of blade-type elongated terminals 30 and 32 which parallel each other and extend longitudinally of the body 14. First end portions 34 of the terminals 30 and 32 project endwise outwardly from the end face 36 of the first end portion 16 of the body 14 and are equipped with transverse bores 38, as is conventional. Further, it will be noted that the terminals 30 and 32 are of the folded type and include second end portions 40 disposed within the arms 22 and 24 of the cavity 20 and equipped with lateral bores 42 through which the exposed ends 44 of a pair of insulated conductors 46 project and are soldered for electrical connection with the terminals 30 and 32. The conductors 46 extend outwardly from the body 14 through the leg 26 of the cavity 20 and the conductors 46 are knotted as at 48 at the intersection of the inner end of the leg 26 of the cavity 20 and the arms 22 and 24 of the cavity 20.

The aforementioned structure of the plug 10 is to be considered as substantially conventional. However, the body 14 includes a pair of remote longitudinal sides 50 which include outwardly projecting abutments 52 on their ends adjacent the end face 36 and the abutments 52 include laterally outwardly bevelled surfaces 54 facing outwardly of the end face 36. In addition, the central portion of the body 14 between the terminals 30 and 32 includes a blind bore 56 formed therein which parallels the terminals 30 and 32 and opens endwise outwardly at its open end through the end face 36.

A protective cover sleeve 58 is provided and closed at one end by an end wall 60 and open at its opposite end. In addition, the sleeve 58 includes remote longitudinal side walls 62 having longitudinal slots 64 formed therein. Also, the end wall 60 includes thickened portions 66 through which openings 68 are formed and the first end portions 34 of the terminals 30 and 32 are slidably received through the openings 68.

The sleeve 58 is slidingly telescoped over the body first end portion 16 and is also constructed of a suitable dielectric material such as ABS plastic and is thus somewhat flexible. Further, the ends of the slots 64 remote from the end wall 60 are closed by transverse wall portions 70 including full width laterally inwardly bevelled surfaces 72 and the open end of the sleeve may be assembled relative to the body 14 by axially displacing the sleeve 58 toward the second end portion 18 of the body 14 after having engaged the bevelled surfaces 72 with the bevelled surfaces 54, thus slightly spreading open the open end of the sleeve 58 and enabling the transverse wall portions 70 to ride over the projections 52.

Figure 2:
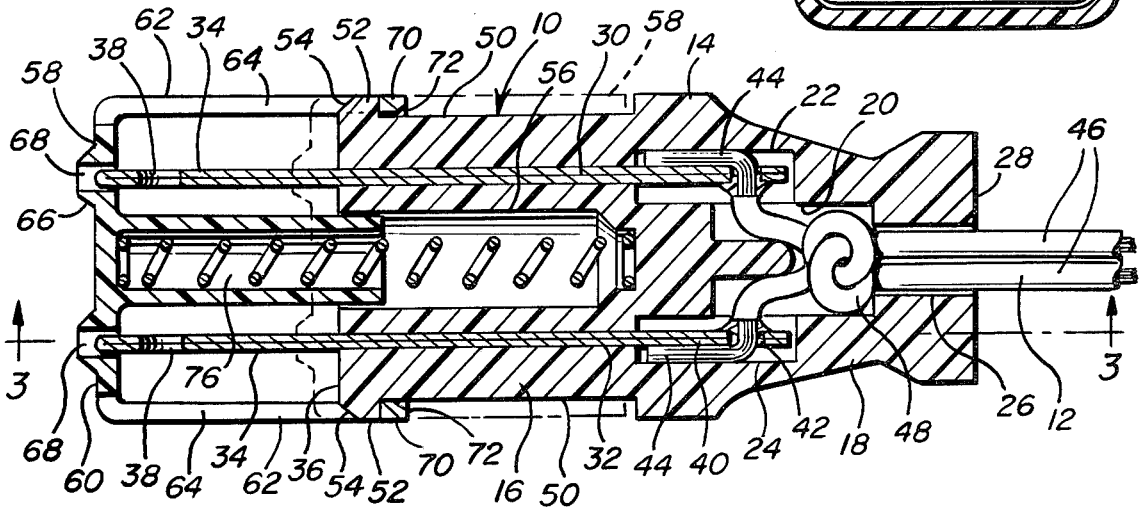
FIG. 2 is an enlarged longitudinal vertical sectional view taken substantially upon the plane indicated by the section line 2—2 of FIG. 1.
Figure 3:
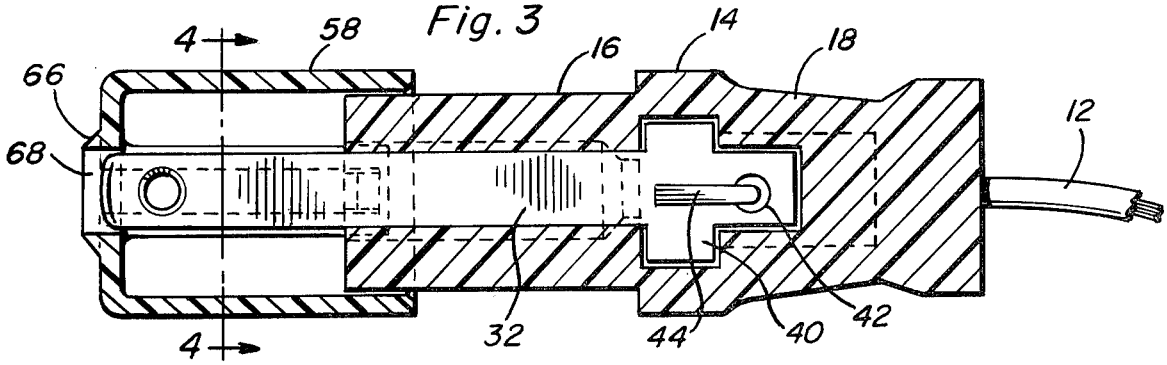
FIG. 3 is a longitudinal sectional view taken substantially upon the plane indicated by the section line 3—3 of FIG. 2.
Figure 6:
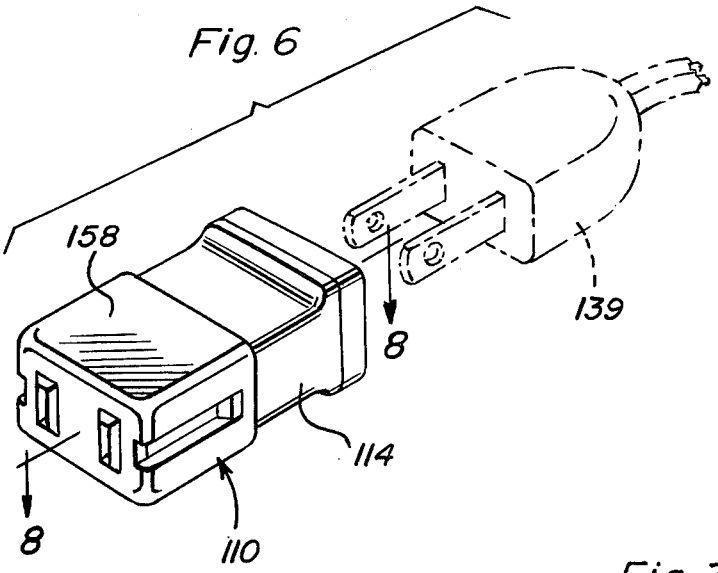
FIG. 6 is a perspective view of an adapter plug form of the instant invention operatively associated with a conventional male plug illustrated in exploded position and in phantom lines.
Figure 11:
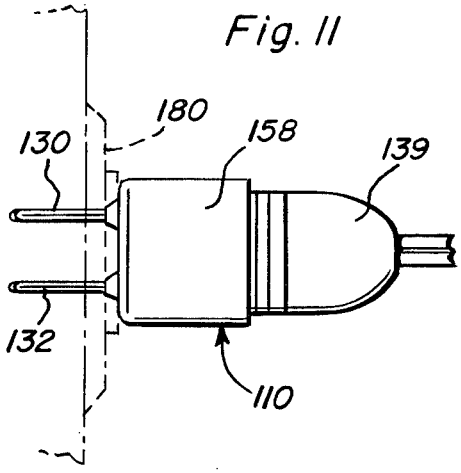
FIG. 11 is a side elevational view of the adapter in operative association with a conventional male plug illustrated in solid lines and an electrical receptacle socket illustrated in phantom lines.
Figure 7:
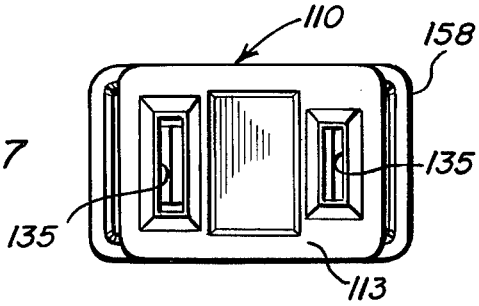
FIG. 7 is an enlarged end elevational view of the adapter as seen from the right side of FIG. 6.
Figure 8:
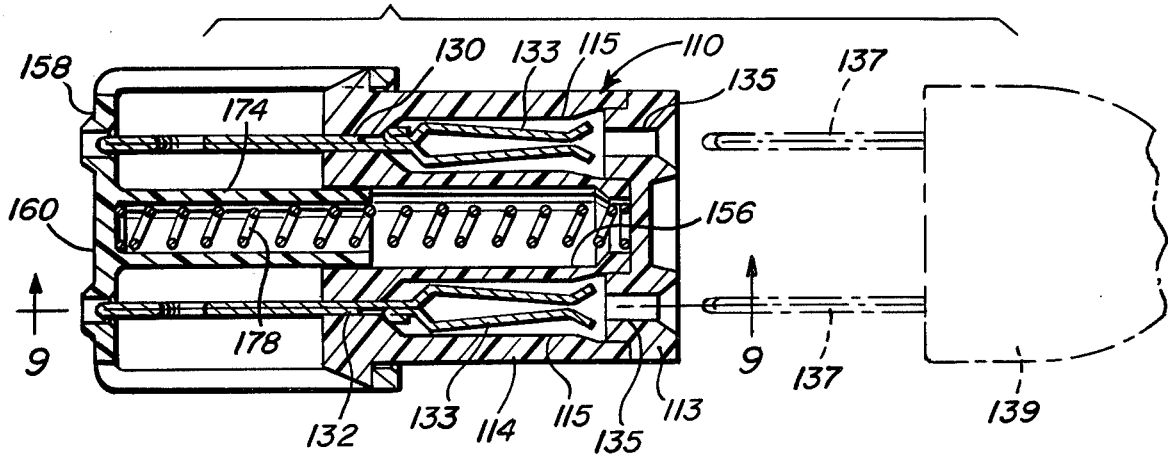
FIG. 8 is an enlarged longitudinal vertical sectional view taken substantially upon the plane indicated by the section line 8—8 of FIG. 6.
Figure 9:
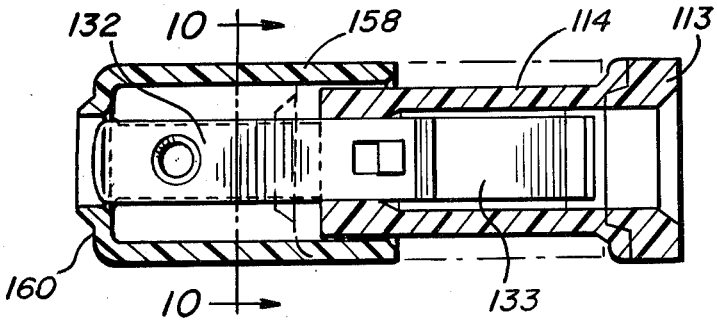
FIG. 9 is a longitudinal sectional view taken substantially upon the plane indicated by the section line 9—9 of FIG. 8.
Figure 10:
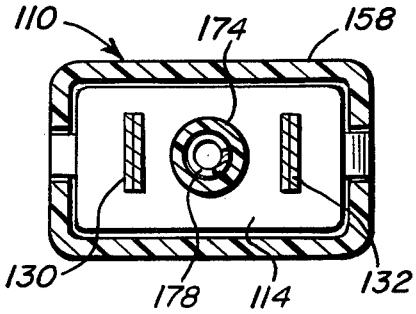
FIG. 10 is a transverse sectional view taken substantially upon the plane indicated by the section line 10—10 of FIG. 9.

After thus being assembled, the sleeve 58 is mounted on the first end portion 16 of the body 14 for shifting between the extended position thereof illustrated in FIG. 1 of the drawings, with the free ends of the terminals 30 and 32 spaced inwardly of the outer ends of the openings 68 and a fully retracted position, such as that illustrated in phantom lines in FIG. 2 of the drawings, with the inner surface of the end wall 60 abutted against the end face 36 of the body 14.

The central area of the end wall 60 includes a projection 74 supported therefrom projecting inwardly from the end wall 60 and including a blind bore 76 formed therein. The free end of the projection 74 is slidably received in the blind bore 56 and an expansion spring 78 has its opposite ends seated in the blind bores 56 and 76 and yieldingly biases the sleeve 58 toward the extended terminal enclosing position thereof illustrated in solid lines in FIG. 2.

Figure 5:
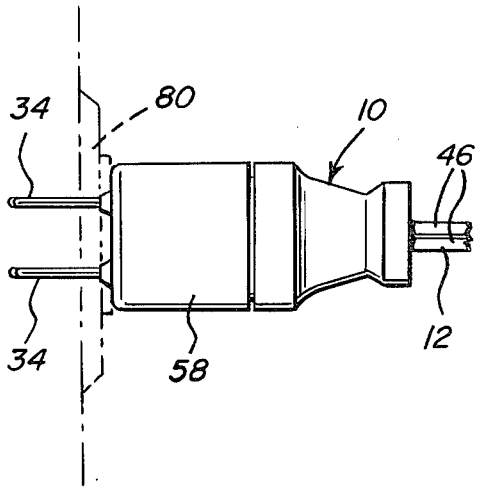
FIG. 5 is a side elevational view of the plug illustrated in FIGS. 1–4 and with the plug operatively associated with an electrical receptacle illustrated in phantom lines.
Figure 4:
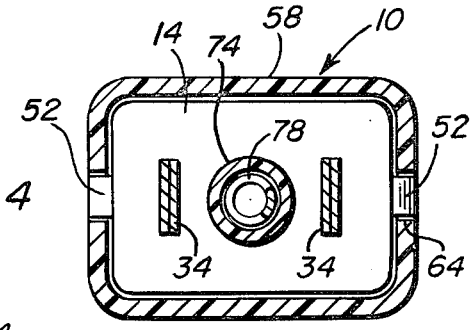
FIG. 4 is a transverse sectional view taken substantially upon the plane indicated by the section line 4—4 of FIG. 3.

With attention now invited more specifically to FIG. 1 of the drawings, it may be seen that the plug 10, when not operatively connected with a suitable wall receptacle, has its terminals 30 and 32 fully enclosed within the sleeve 58 and, therefore, the terminals 30 and 32 are not exposed for bridging by one or more fingers of the user of the plug as the plug is being operatively engaged with a wall receptacle, such as that illustrated in phantom lines in FIG. 5 of the drawings and designated by the reference numeral 80. However, the projections 66 are positioned for seated engagement in the existing recesses surrounding the terminal receiving openings of the wall receptacle in order that the plug 10 may have its terminals 30 and 32 properly aligned with the wall receptacle terminal receiving sockets immediately prior to axial displacement of the plug body 14 toward the wall receptacle 18 in order to simultaneously retract the sleeve 58 and extend the terminals 30 and 32 into the wall receptacle 80.

With attention now invited more specifically to FIGS. 6 through 11 of the drawings, there may be seen a second embodiment of the invention in the form of an adapter referred to in general by the reference numeral 110. The adapter 110 includes many structural features which are identical or at least substantially similar to the various above-described structural features of the plug 10. Those structural features of the adapter 110 which are identical or substantially similar to the various features of the plug 10 are designated by reference numerals in the 100 series which correspond to the reference numerals designating the similar components of the plug 10.

The adapter 110 includes a body 114 which is similar to the first end portion 16 of the body 14, but the body 114 includes a separate end piece 113 in lieu of the second end portion 18 of the body 14. The end piece 113 is suitably secured, as by sonic welding or any other desirable method, over the end of the body 114 remote from the sleeve 158 corresponding to the sleeve 58. The end of the body 114 over which the end piece 113 is secured includes a pair of outwardly opening sockets 115 formed therein and the terminals 130 and 132 include forked terminal ends 133 centrally disposed in the sockets 115. The end piece 113 includes openings 135 formed therethrough by which the outwardly projecting terminals 137 of a male plug 139 may be inserted into the adapter 110 into electrical contact with the terminal ends 133. In this manner, the conventional male plug 139 may be provided with the adapter 110 in order to provide the same protection against exposed terminals 130 and 132 as that provided by the plug 10.

The end piece 113 defines the inner extremity of a bore 156 corresponding to the bore 56 and the spring 178 corresponding to the spring 78 has its end remote from the sleeve end wall 160 seated against the central portion of the end plate 113. Further, the terminal ends 133 are constructed of spring material and are effective to frictionally grip the terminals 137 whereby a pull on the plug 139 will be sufficient to extract the terminals 130 and 132 from the wall receptacle 180 rather than withdrawing the terminals 137 of the plug 139 from the adapter 110.

Thus, after the plug 138 has been operatively engaged with the adapter 110, the adapter 110 and plug 139 function exactly as the plug 10 functions.

Further, it is to be noted that the plug 10 will be utilized on newly manufactured electrical appliances and the like, and that the adapter 110 will be sold for use in conjunction with a standard plug, such as the plug 139.

The plug 10 and adapter 110 each represent an important safety item. If either is used on the end of a lamp or other appliance cord, the danger of receiving a shock when either inserting a plug into a wall receptacle or removing a plug from a wall receptacle is substantially eliminated. It is often necessary to plug in or unplug a night light or other lamp cord behind a dresser or other piece of furniture which is difficult to move and if the wall socket is behind the piece of furniture the plugging in or unplugging of a lamp cord or the like is done to a great extent by feel. It is in these and other instances that persons plugging in or unplugging a lamp or other appliance cord occasionally receives shocks. Also, persons having poor eyesight as well as persons with good eyesight occasionally attempt to plug in or unplug an appliance cord in a room which is dimly lighted. Further, there are other instances in which the plug 10 and adapter 110 of the instant invention will be of use in substantially eliminating the possibility of a person plugging in or unplugging the plug 10 and adapter 110 receiving a shock.

In addition, it is pointed out that the longitudinal side walls 62 and the projection 74 are slidably engaged with the sides 50 and surfaces defining the bore 56 to assure non-binding guiding action between the sleeve 58 and the body 14 with a minimum of guiding structure. Also, the bevelled surfaces 72 assist in guiding movement of the sleeve 58 on the body 14 in the event there is any tendency for the sleeve 58 to be "cocked" on the body 14.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated body constructed of dialectric material, said body including opposite end portions, one of said end portions including a pair of parallel elongated terminals constructed of conductive material embedded therein and having one pair of ends thereof projecting endwise outwardly of said one end portion of the body, the other ends of said terminals being disposed in the other end portion of said body and being adapted for electrical connection with a pair of conductors, said one end portion of said body including a longitudinal bore formed therein intermediate and paralleling said terminals and opening endwise outwardly of said one end portion, said one body end portion including remote longitudinal side surfaces, the ends of said surfaces adjacent said one end portion including laterally outwardly projecting abutments, and a protective sleeve snugly slidably disposed over and shiftable longitudinally of said one end portion of said body and including remote longitudinal walls having slots formed therein in which said abutments are slidably received, the end of said sleeve corresponding to said one end portion of said body being closed by an end wall extending thereacross, said end wall having a pair of openings formed therethrough in which said terminals are slidably received, the ends of said slots remote from said end wall being closed and abuttingly engageable with said abutments to limit sliding movement of said sleeve away from said other end portion of said body to a position with the free ends of said terminals disposed in and spaced inwardly of the opposite ends of said openings, said end wall being abuttingly engageable with said one end portion of said body to limit sliding movement of said sleeve toward said other end portion of said body, and a coiled compression spring having one end seated in said bore and the other end abutted against said end wall.

2. The body of claim 1 wherein the sides of said abutment facing outwardly of said one end portion of said body and the end portions of said remote longitudinal walls remote from said end wall and aligned with said slots being outwardly and inwardly bevelled, respectively.

3. The body of claim 1 wherein said other end portion of said body includes a Y-shaped cavity formed therein including a pair of arm portions into which said other ends of said terminals project and a base leg portion opening endwise outwardly of said other end portion of said body, said cavity being adapted to receive corresponding ends of a pair of insulated conductors therein having their terminal ends stripped of insulation and electrically connected to said other ends of said terminals.

4. The body of claim 1 including means defining a socket on the inner surface of said end wall, the other end of said spring being seated in said socket.

5. The body of claim 4 wherein said means defining said socket includes an elongated projection carried by the inner surface of said end wall and projecting inwardly therefrom and guidingly telescopingly received in said bore, said projection including a blind bore formed therein, the other end of said spring being seated in said blind bore.

6. The body of claim 1 wherein the portions of said end wall disposed about said openings are thickened.

7. The body of claim 6 wherein said thickened portions of said end wall disposed about said openings are defined by outwardly tapering projections formed integrally with said end wall.

8. The body of claim 1 wherein the end portion of said body remote from said one end portion thereof has a pair of openings formed therein registered with said other ends of said terminals and through which the terminals of a conventional male plug may be inserted for electrical contact with said other ends of said terminals.

9. The body of claim 8 wherein said other ends of said terminals define clamp-type terminal ends with which to clampingly electrically engage the terminals of a conventional plug inerted through the last mentioned openings.

10. The body of claim 8 wherein the sides of said abutments facing outwardly of said one end portion of said body and the end portions of said remote longitudinal walls remote from said end wall are outwardly and inwardly bevelled, respectively.

11. The body of claim 8 including means defining a socket on the inner surface of said end wall, the other end of said spring being seated in said socket.

12. The body of claim 11 wherein said means defining said socket includes an elongated projection carried by the inner surface of said end wall and projecting inwardly therefrom and guidingly telescopingly received in said bore, said projection including a blind bore formed therein, the other end of said spring being seated in said blind bore.

* * * * *